US005511984A

United States Patent [19]

Olson et al.

[11] Patent Number: 5,511,984

[45] Date of Patent: Apr. 30, 1996

[54] ELECTRICAL CONNECTOR

[75] Inventors: Stanley W. Olson, East Berlin; Mark Robertson, York, both of Pa.

[73] Assignee: Berg Technology, Inc., Reno, Nev.

[21] Appl. No.: 235,289

[22] Filed: Apr. 29, 1994

Related U.S. Application Data

[63] Continuation-in-part of Ser. No. 221,077, Mar. 31, 1994, which is a continuation-in-part of Ser. No. 193,443, Feb. 8, 1994.

[51] Int. Cl.[6] ..... H01R 9/09

[52] U.S. Cl. ..... 439/79; 439/701; 439/937

[58] Field of Search ..... 439/79, 83, 682, 439/686, 701, 541.5, 381, 660, 937, 736

[56] References Cited

U.S. PATENT DOCUMENTS

| | | | |
|---|---|---|---|
| 3,963,317 | 7/1976 | Eigenbrode et al. | 439/267 |
| 4,036,544 | 7/1977 | Keglewitsch | 439/681 |
| 4,420,215 | 12/1983 | Tengler | 439/682 |
| 4,775,333 | 10/1988 | Grider et al. | 439/736 |
| 4,871,320 | 10/1989 | Mouissie | 439/78 |
| 5,074,039 | 12/1991 | Hillbish et al. | 29/883 |
| 5,133,679 | 7/1992 | Fusselman et al. | 439/608 |
| 5,151,036 | 9/1992 | Fusselman et al. | 439/108 |
| 5,213,514 | 5/1993 | Arai | 439/79 |
| 5,236,368 | 8/1993 | Adams et al. | 439/79 |

FOREIGN PATENT DOCUMENTS 879968 1/1959 United Kingdom .

*Primary Examiner*—Gary F. Paumen
*Assistant Examiner*—Hien D. Vu
*Attorney, Agent, or Firm*—Woodcock Washburn Kurtz Mackiewicz & Norris

[57] ABSTRACT

An electrical connector assembly according to the current invention comprises a receptacle and a right angle header for connecting two or more printed circuit boards. A composite action beam is located in the receptacle and has a movable end and a fixed end. During an initial phase of the pin insertion cycle, the movable end of the composite action beam deflects so as to minimize the force necessary to insert the pin into the connector housing. During an intermediate phase of the insertion cycle, the movable end contacts an inside wall of the connector and the composite action beam functions as a two-end supported beam. The composite action beam supported at both ends exerts sufficiently high normal force against the inserted pin so as to retain the pin in the inserted position. Thus, the composite action beam reduces insertion force without compromising normal retention force once the pin is inserted. The pins are positively aligned in a header housing such that component tolerances are maintained and a large array of pins can be easily inserted into connection with the printed circuit board at one end and into connection with the receptacle at the other end.

9 Claims, 12 Drawing Sheets

ELECTRICAL CONNECTOR

CROSS REFERENCE TO RELATED APPLICATIONS

This application is a continuation-in-part of U.S. application Ser. No. 08/221,077, filed Mar. 31, 1994, which is a continuation-in-part of U.S. application Ser. No. 08/193,443, filed Feb. 8, 1994.

FIELD OF THE INVENTION

This invention relates to the field of electrical connectors. More particularly, this invention relates to miniature or high density connectors wherein a relatively low force is necessary to insert a pin in the connector housing for electrical connection to a printed substrate or the like and wherein a spring contact applies a relatively high normal force against the pin for retaining the pin in the connector housing.

BACKGROUND OF THE INVENTION

In electrical connector design, miniaturization has become an increasingly important consideration. However, there is a trade off between connector performance and reduced size. As the size of the connector is reduced, less space is available within the receptacle housing of the connector for a connector beam. Such a limited space makes it increasingly difficult to provide a low pin insertion force relative to a high normal retention force, while maintaining the desirable tolerances of the connector structure.

In a compact connector, the above-mentioned low insertion force is a significant design factor. As the area required for each pin-to-beam contact is reduced, more contacts may be placed in the connector. Heretofore, more force was necessary for inserting a component within such a connector. Such increased insertion force, particularly where the connector is mounted on a printed circuit board, can result in an unreliable connection, bending of the printed board and solder joint cracking.

Cantilever beams have been used in the art to provide low insertion force. The cantilever beam is generally supported only by one end so that the other end can move during a pin insertion cycle and the beam is thin in order to provide for the necessary deflection. When a pin is initially inserted into a connector housing, the pin touches the movable end of the beam. When the pin is inserted further, the movable end is pushed away in a direction that is substantially transverse to the pin insertion axis to accommodate penetration of the pin. This movement allows low insertion force for an easy insertion. However, when the pin is completely inserted into the connector, such a thin cantilever beam does not apply a desirably high normal force against the inserted pin in order to retain the pin in the connector housing.

On the other hand, a supported beam provides high normal force against a completely inserted pin. Since the supported beam is generally supported by both ends, unlike a cantilever beam, either end of the supported beam does not move. During the pin insertion cycle, the supported beam only deflects. Accordingly, the supported beam tends to require high insertion force during an initial phase of an insertion cycle. Since a compact connector assembly may accommodate a large number of contacts, the total amount of necessary insertion force is undesirably high.

Thus, neither a cantilever beam nor a supported beam alone may be appropriate for a compact connector. A cantilever beam may require low initial insertion force, but it may provide sufficient normal retention force against a completely inserted pin. A cantilever beam also requires a larger space for the movable end. A supported beam, on the other hand, may provide sufficient normal force against an inserted pin, but requires large insertion force during an initial phase of an insertion cycle. Accordingly, a large number of pins cannot be placed on the same connector with supported beams due to the larger insertion force.

Regarding the header of such a miniature connector, during the manufacturing process it is paramount that the terminal pins be aligned within the desired tolerances. Thus, upon connection of the header and receptacle the pins can be simply placed in the corresponding openings in the receptacle housing without any excessive force which could damage or break the miniature connector.

Thus, there is a need for an electrical connector wherein a relatively low force is necessary to insert a pin in the connector housing for electrical connection to a printed substrate or the like and wherein a spring beam contact applies a relatively high normal force against the pin for retaining the pin in the connector housing. The present invention provides an electrical connector which satisfies this need.

SUMMARY OF THE INVENTION

Accordingly, the current invention provides a compact electrical connector with low insertion force relative to high normal retention force, while allowing for desired tolerances in the connector structure. Thus, one object of the current invention is to limit height, width and pitch of a connectors. Another object is to provide low insertion force at least during an initial phase of an insertion cycle. Yet another object of the current invention is to provide high normal force against the inserted pin in order to retain the pin within the connector housing. Lastly, another object of the invention is to provide the ability to maintain desirable tolerances during all phases of the manufacture and use of the connector.

According to one aspect of the current invention, an electrical connector assembly for electrically connecting a pin comprises a receptacle having a bore along a pin insertion axis, the bore having inner walls, and a composite action beam located in the bore for providing a substantially low insertion force or low spring rate during the initial phase of insertion of the pin and providing a substantially high normal force against the pin during a later phase of the insertion.

According to another aspect of the current application, the composite action beam has a unsupported end and a supported end. The composite action beam provides a substantially low deflection rate at the unsupported end during an initial phase of insertion, and the composite action beam functions as a cantilever beam during the initial phase. The unsupported end is abutted against one of the inner walls during a later phase of the insertion, the composite action beam then functioning as a supported beam, thus providing a substantially high normal retention force against the pin.

According to a third aspect of the invention, an electrical connector for electrically connecting a pin having a central pin axis, comprises a housing having a top and bottom surface, an insertion bore defining an insertion surface and a spring retention bore defining a retention surface. The insertion bore is in communication with the spring retention bore and the insertion surface is substantially aligned with the retention surface. The insertion bore has a central insertion axis and the housing further has a cavity formed in the bottom surface. A retention spring is disposed within a receptacle and the receptacle is disposed within the housing cavity and is mechanically connected to the housing such that the receptacle is retained in the housing and the retention spring extends into the spring retention bore. The pin is inserted into the insertion bore with the central pin axis being substantially coincidental with the central insertion axis and the retention spring electrically contacts the pin and retains the pin against the retention surface.

According to yet another aspect of the invention, the pin header provides for effective alignment of the pins such that a large array of pins can be connected to a printed circuit board without damaging the miniature connector and without interference such as pin stubbing. The pins are mounted in alignment wafers which provide for effective alignment of the pins into individual pin rows. The pin array is inserted at the printed circuit board end into a stand-off pin guide which provides for effective alignment of the pins onto the printed circuit board.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

BRIEF DESCRIPTION OF THE DRAWINGS

FIG., 1A diagrammatically illustrates a cross-section of a preferred embodiment of a miniature connector and a pin according to the current invention during an initial phase of an insertion cycle.

DETAILED DESCRIPTION OF THE PREFERRED EMBODIMENT(S)

Figure 1A:
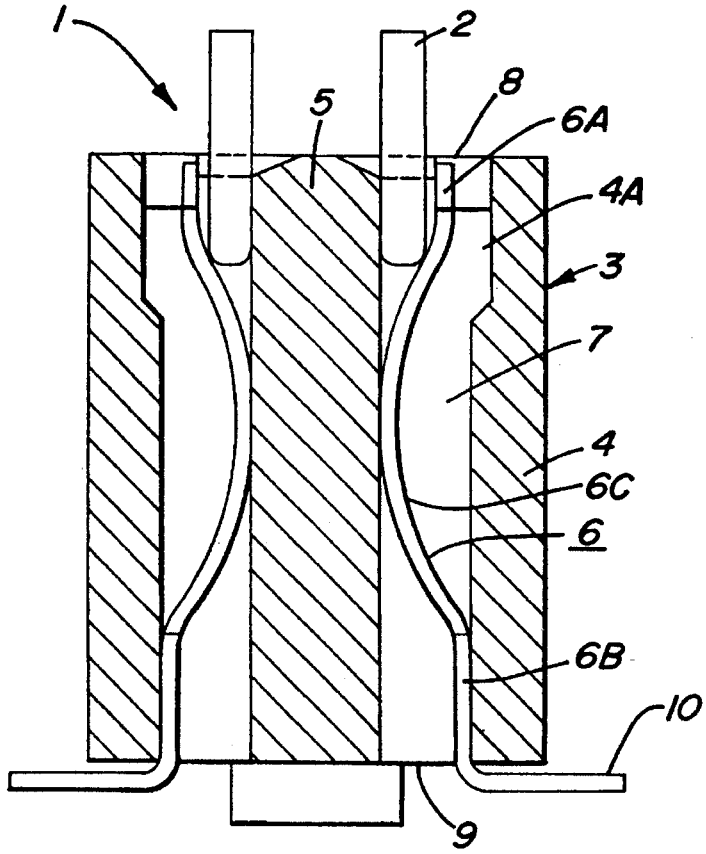
FIG. 1B diagrammatically illustrates a top view of the miniature connector of the current invention.
FIG. 1C shows another cross-sectional view of the miniature connector at 1C—1C of FIG. 1B.

Referring now to the drawings, wherein like reference numerals designate corresponding structure throughout the views.

FIG. 1A shows a cross sectional view of one preferred embodiment of a compact connector assembly according to the current invention. The assembly 1 comprises a pin 2 and a compact connector or receptacle 3. The compact connector 3 further comprises a side wall 4, an inner wall 5 and an electrically-conductive composite action beam 6. The composite action beam 6 is located in a bore 7 which is limited by the inner wall 5 and the sidewall 4. A movable or unsupported end 6A of the composite action beam 6 is located near a pin receiving opening 8 while a fixed or supported end 6B of the composite action beam 6 is located near a solder tail opening 9. A solder tail 10 of the composite action beam 6 is continuous with the composite action beam 6 at the fixed end 6B and protrudes through the solder tail opening 9. The solder tail 10 bends 90° around a bottom of the sidewall 4 and extends horizontally beyond the sidewall 4.

Still referring to FIG. 1A, the movable end 6A makes a contact with the pin 2 during an initial phase of an insertion cycle. The angle of attack by the pin 2 with respect to the movable end 6A may be relatively high during this initial phase, compared to later phases of the insertion cycle. In a preferred embodiment, the movable side 6A is located to one side of the pin receiving opening 8 during this phase of insertion. The center of arch 6C of the composite action beam 6 can abut against the inside wall 5. The pin-receiving opening 8 can be partially further indented on a surface 4A facing the movable end 6A. The deflection rate during the initial phase can be approximately 4 gram per mil according to a preferred embodiment of the current invention. The movable end 6A functions as a cantilever beam and requires low insertion force during this initial phase.

Figure 1C:
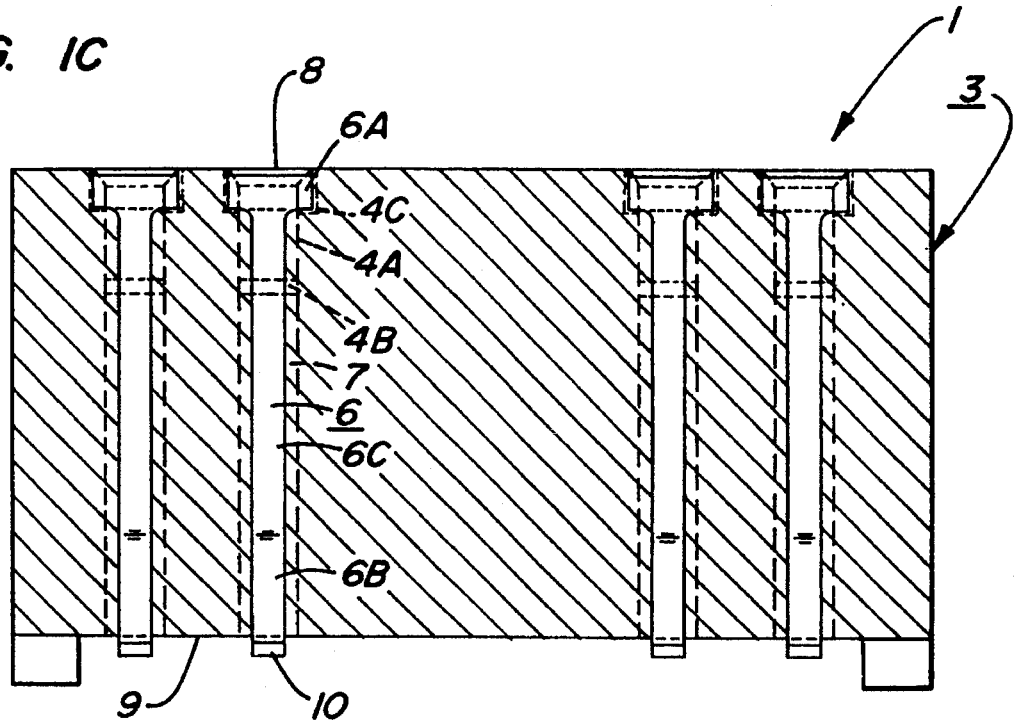
Figure 1B:
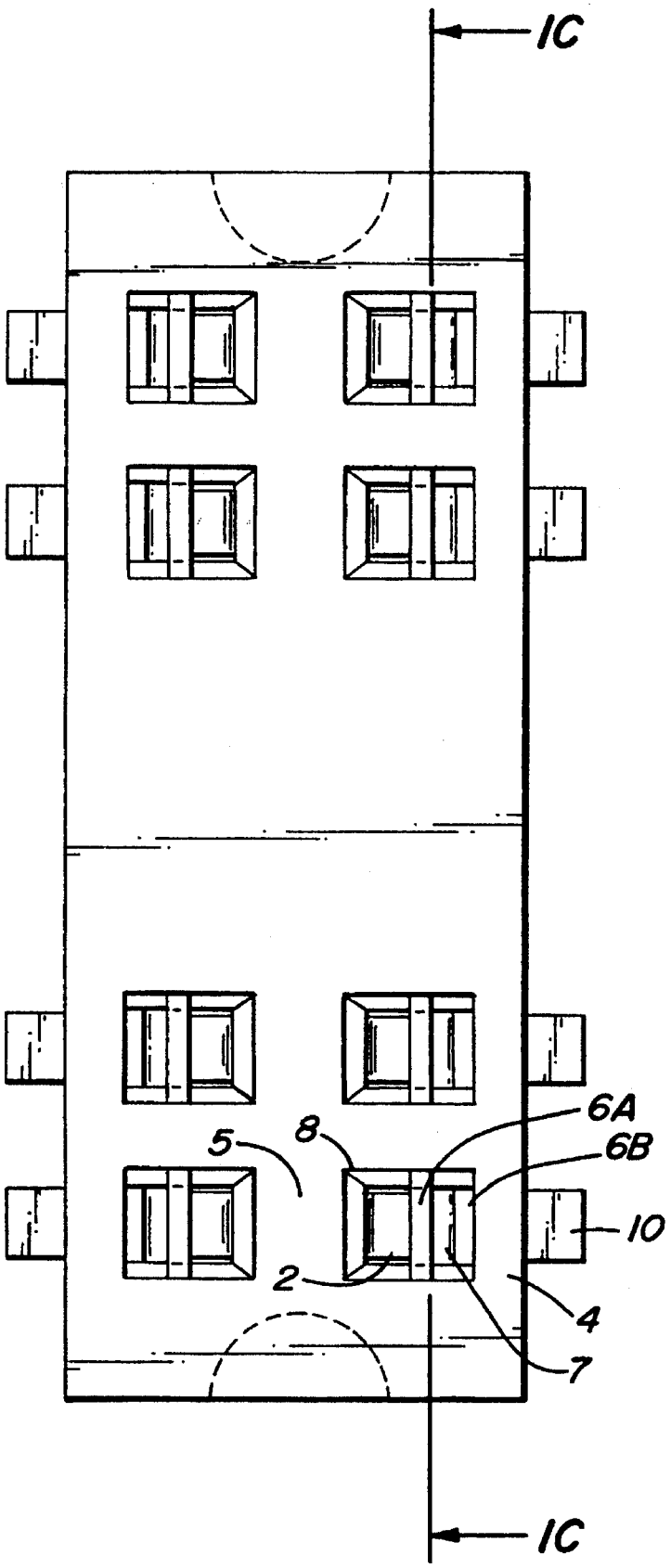

Now referring to FIG. 1B, relative locations of the above discussed components in the compact connector according to the current invention are shown in a top view. In a pin-receiving opening 8, the pin 2 is shown in the most inner part against the inner wall 5. The pin 2 contacts the movable end 6A of the composite action beam 6 in an approximately center location of the pin receiving opening 8. Lateral to the movable end 6A is a space 7 and the fixed end 6B which abuts the sidewall 4. Further lateral to the sidewall 4 is a portion of the solder tail 10, which extends beyond the sidewall 4. In the embodiment shown in FIG. 1B, there are eight pin-to-beam contacts on the connector. It is noted, however, that such a connector feature would most likely be applicable in high pin count configurations.

FIG. 1C shows another cross-sectional view of the miniature connector at 1C—1C of FIG. 1B. The pin-receiving opening 8 has a larger diameter than the width of the composite action beam 6. The bore 7 indicated by a dotted line is limited by the inside walls of the connector 3. The composite action beam 6 shown in solid line has the movable end 6A near the pin-receiving opening 8, the arch portion 6C near the center of the bore 7 and the fixed end 6B near the solder tail opening 9. The solder tail 10 is contiguous with the fixed end 6B. The indented surface 4A further comprises a transition area 4B between the indented surface 4A and the inner surface of the side wall 4. The indented surface further comprises movable area 4C where a movement of the movable end 6A of the composite action beam 6 is accommodated. Thus, the movable end of the composite action beam 6 is guided within movable area 4C of the indented surface 4A so as to minimize the deviation from a predetermined course of movement. In a preferred embodiment, the width of the movable end 6A and the corresponding moveable area 4C is wider than the rest of the composite action beam 6 or the bore 7. This width differentiation prevents the moveable end 6A of the composite action beam from being pushed down towards the fixed end 6B so as to maintain its substantially horizontal movement near the pin-receiving opening 8 during the pin insertion cycle.

It will be noted in FIG. 1A, that solder tail opening 9 is filled. In such a construction it may not be necessary to provide movable end 6A with a portion that is wider than the composite action beam 6 or bore 7. Similarly, if movable end 6A is constructed as shown, it may not be necessary to fill solder tail opening 9. One advantage to filling solder tail opening 9 is the prevention of solder from flowing into bore 7 during mounting of the connector.

Figure 2:
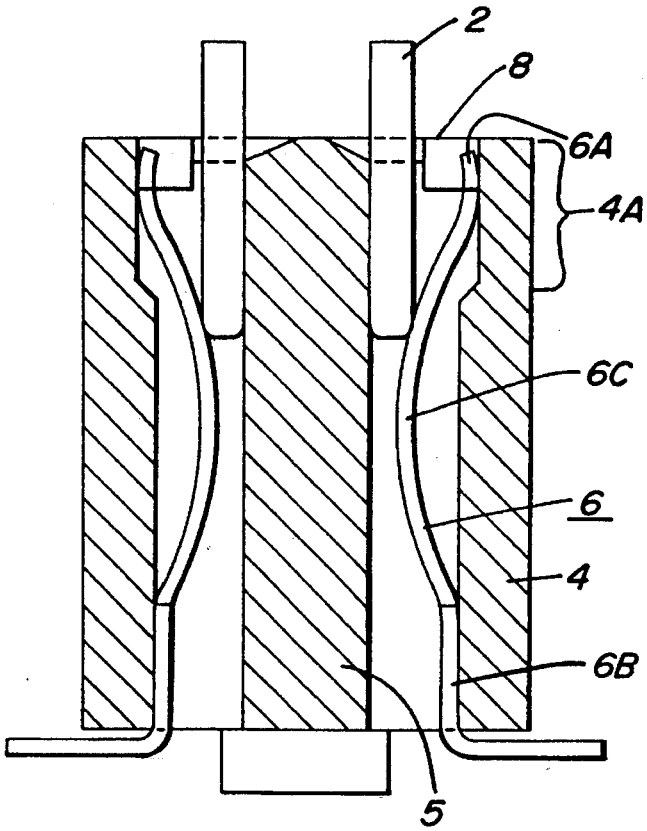
FIG. 2 shows a cross-sectional view of the miniature connector as in FIG. 1A and a pin during an intermediate phase of the insertion cycle.

FIG. 2 illustrates an intermediate phase of the pin insertion cycle in a preferred embodiment according to the current invention as shown in FIG. 1A. The pin is further inserted towards the center of the arch 6C of the composite action beam 6. To accommodate further insertion, the movable end 6A functions as a cantilever beam, and the movable end 6A moves towards the partially indented surface 4A of the sidewall 4. The partially indented surface 4A of the sidewall 4 can serve to narrow the overall width of the connector assembly 1. The movable end then abuts against the partially intended surface 4A as shown in FIG. 2. At this point, the composite action beam 6 goes through a transition from a cantilever beam to a supported beam. Neither end of the composite action beam 6 no longer horizontally moves to accommodate further pin insertion. However, the center of the arch 6C deflects from this point on. As the center of the arch 6C deflects, the movable end 6A may move in the direction of an axis of insertion toward the pin receiving opening 8. The fixed end 6B of the composite action beam 6 remains stationary with respect to the sidewall 4. Accordingly, the deflection rate may increase up to approximately 16 grams per mil after the composite beam 6 acts as a two-point supported beam in a preferred embodiment of the current invention.

Figure 3:
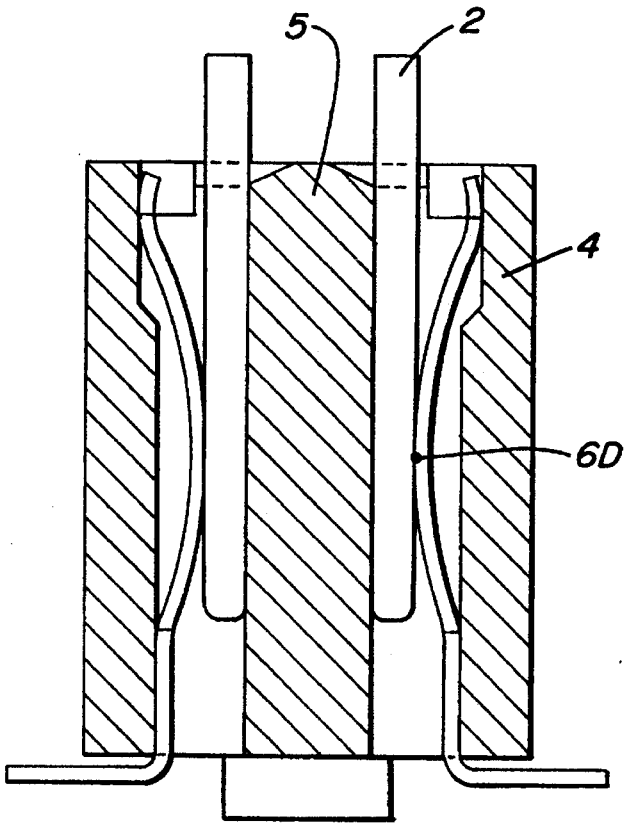
FIG. 3 illustrates a cross-sectional view of the miniature connector and the pin of the current invention as in FIG. 1A after the pin is completely inserted into the connector.

Now referring to FIG. 3, the pin 2 has reached the final insertion point. The pin 2 is pressed against the inner wall 5 by the composite action beam 6 at a Hertzian stress dot 6D. In this final insertion phase, the composite action beam 6 provides high normal force against the pin 2 relative to initial insertion force so as to retain the pin 2 in the final position. The composite action beam 6 now remains to function as a two-point supported beam.

It will also be noted that an anti-stubbing top 11 has been added to connector 1 which extends over pin receiving opening 8. The function of top 11 is to prevent stubbing of pins 2 on composite beam 6. In order to assist in the insertion of pins 2, the end portion of top 11 extending over pin receiving opening 8 is chamfered or tapered.

In summary, FIGS. 1–3 illustrate a transition of the composite action beam 6 from a cantilever beam to a supported beam. Such a transition in the beam 6 yields low insertion force during an initial phase relative to high normal force against a completely inserted pin. Low insertion force is an advantage for a compact connector. Since the area required for each pin-to-beam contact is smaller with the composite action beam of the current invention, a larger number of the contacts may be placed in the compact connector. Thus, a total amount of insertion force needs to be kept minimal so as to make insertion relatively easy and reliable. The composite action beam of the current invention satisfies such a low insertion force requirement. At the same time, when a pin is completely inserted, sufficiently high normal force against the pin is also provided by the composite action beam of the current invention. Therefore, the composite action beam of the current invention combines the advantageous features of the cantilever beam and the supported beam without sacrificing the space limitation of a compact connector.

Figure 4:
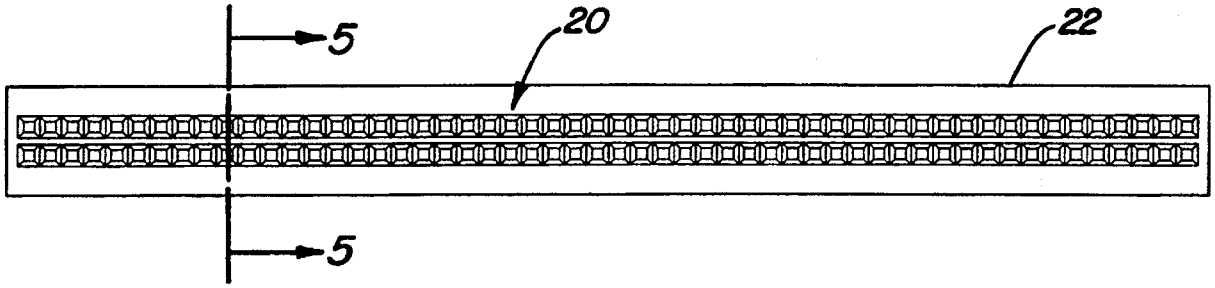
FIG. 4 shows a top view of a further embodiment of an electrical connector in accordance with the present invention.
Figure 5:
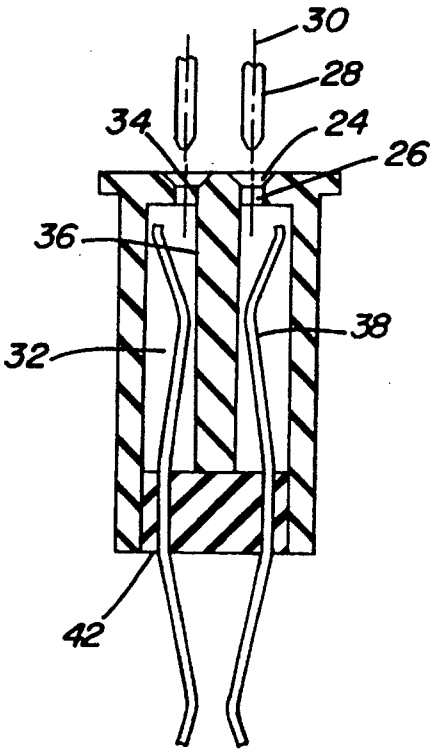
FIG. 5 shows a cross-sectional view taken along the lines 4—4 of the electrical connector of FIG. 4.

Another embodiment of an electrical connector in accordance with the present invention is shown in FIGS. 4 and 5. In this embodiment, adjacent pin insertion openings 20 in the connector housing 22 are closely spaced together, both in the longitudinal and lateral direction. A counter-sink bore 24 of each pin insertion opening 20 is in communication with an insertion bore 26 such that the counter-sink bore facilitates easy insertion of adjacent pins 28 into the insertion bores 26 of laterally adjacent pin insertion openings 20. Pin 28 and the counter-sink bore 24 and insertion bore 26 all have a coincidental central axis 30 such that the pins 28 are inserted into the openings 20 along the central axis 30. The insertion bores 26 are only slightly larger than, and preferably the same shape as, the external surface of the pins 28, taking into account the necessary tolerances of the structure.

The insertion bore 26 of each opening 20 is in communication with a spring retention bore 32 in the housing, with the central axis of the spring retention bore being parallel to, but displaced from, the axis of insertion of the pins along central axis 30. A surface 34 of the insertion bore 26 is substantially aligned with a surface 36 of the spring retention bore 32 such that the pins 28 are inserted into the spring retention bore closely adjacent to, and preferably contacting, the surface 36 of the spring retention bore 32. The pins 28 are thus inserted into contact with the contact beams 38 in the manner described above such that the pins are retained against the surface 36. In this manner, the tolerances of the assembly can be low, while ensuring that the pins contact a wall of the housing when the contact beam applies a high normal force in order to retain the pins in the housing.

Figure 7A:
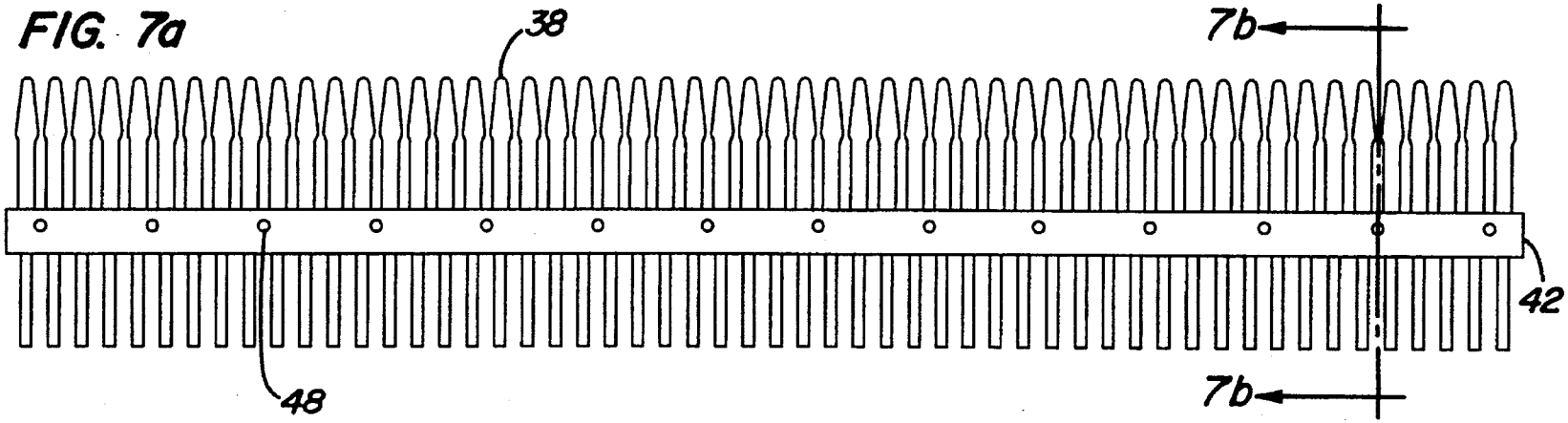
FIG. 7*a* shows a receptacle and retention spring assembly in accordance with the present invention.
Figure 7B:
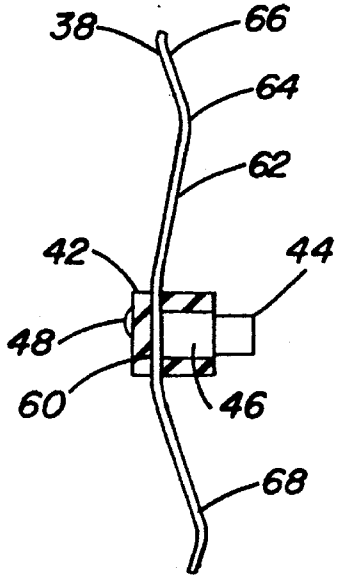
FIG. 7*b* shows a cross-sectional view taken along the lines 7—7 of the receptacle and retention spring assembly of FIG. 7*a*.

Referring to FIGS. **6*a*–6*c*, wherein an embodiment of the connector housing is shown without the contact beams, the connector housing 22 has a cavity 40 in the bottom surface 41. Referring to FIG. 5, the contact beams 38 are mounted in a receptacle 42 such that the contact beams are detachably mounted within the housing when the receptacle 42 is mounted into the cavity 40. As shown in FIGS. 7*a*–7*b*, in a preferred embodiment, one row of contact beams is disposed in one half of a receptacle 42. In such an embodiment, each half of the receptacle 42 includes alternating pins 44 and holes 46, which are preferably square. In this manner, these rows of contact beams are easily manufactured separately and subsequently assembled together with the pins of one row connected into a corresponding hole of another row in a known manner to form a single receptacle having adjacent rows of contact beams. Accordingly, the rows of adjacent contact beams are inserted into the spring retention bore and detentes 48 on the receptacle 42 engage the walls 50** of the connector housing, causing elastic deformation of the walls in the area of the detentes, such that the receptacle is mechanically connected to the connector housing.

Figure 6A:
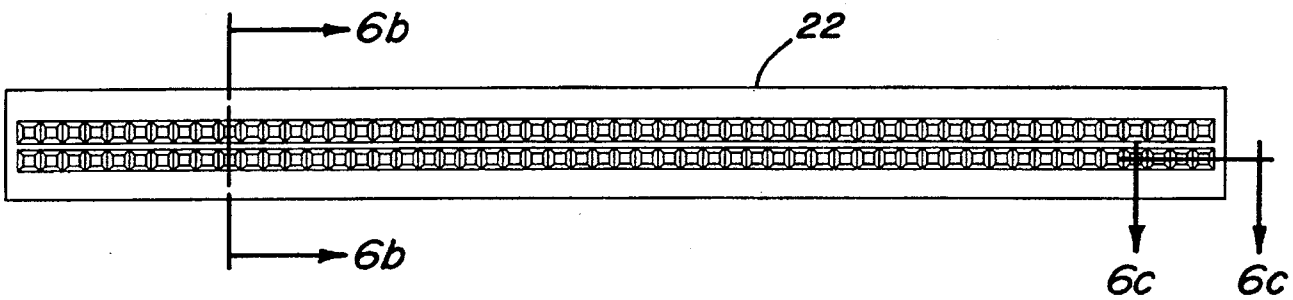
FIG. 6*a* shows a top view of an embodiment of a connector housing in accordance with the present invention.
Figure 6C:
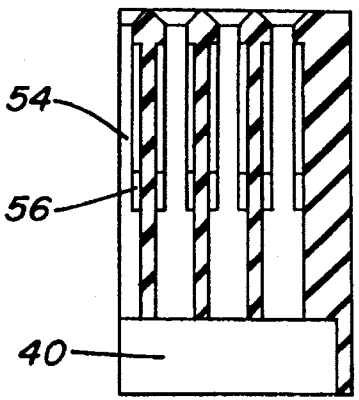
FIG. 6*c* shows a partial longitudinal cross-sectional view taken along the lines 6*c*–6*c* of the connector housing of FIG. 6*a*.
Figure 6B:
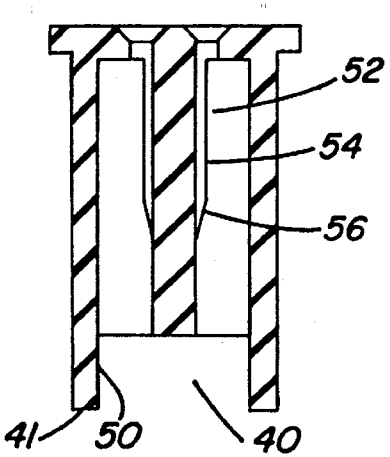
FIG. 6*b* shows a lateral cross-sectional view taken along the lines 6*b*–6*b* of the connector housing of FIG. 6*a*.

Referring to FIGS. 6*b*–6*c*, in order to facilitate insertion of the contact beam rows into the housing, in a preferred embodiment connector housing 22 includes beam insertion ramps 52. These ramps comprise a flat portion 54, extending from the base of the insertion bore, and a sloped portion 56 which extends toward the bottom surface 41 of the connector housing. Upon insertion of the contact beams in the spring retention bore, the contact beams slide up the sloped portion 54 and onto the flat portion 56 such that all of the insertion tolerances are applied to one side of the connector housing and can be accounted for during manufacture of the connector structure. It should be noted that in this embodiment a small additional insertion force on the pins 28 will be necessary to insert the pins into the housing, since the insertion ramps 52 impart a small load on the contact beams as they come into contact with the surface 36 of the connector housing in the spring retention bore.

A preferred embodiment of a contact beam 38 is shown in FIG. 7*b*. A straight portion 60 is disposed within the receptacle 42. Preferably, the straight portion 60 is molded into the receptacle during the manufacture of the beam and receptacle assembly such that solder used to mount the contact beam to a printed substrate cannot flow from the bottom of the connector housing and into the spring retention bore. Another straight portion 62 extends at an angle from one end of the straight portion 60. The straight portion 62 is joined to a curved contact portion 64 and the curved contact portion 64 is joined to top portion 66. The end of the contact beam including the straight portion 60 and curved contact portion 64 is the end that is inserted into the spring retention bore, as shown in FIG. 5. Accordingly, when the pins 28 are inserted into the openings 20 of the housing 22 they contact the curved contact portion 64 of the contact beam 38 and the top portion 66 of the beam deflects away from the surface 36. When the pins 28 are fully inserted into the spring retention bore, the curved contact portion of the contact beam applies a high normal force against the pins for retaining the pins in the housing in the manner described above.

The mounting portion 68 of the contact beam extends from the other end of straight portion 60. In the embodiment shown, mounting portion 68 is for straddle mounting of the connector wherein the mounting portion of the contact beam in the adjacent rows of beams is soldered to a pad on either side of a printed circuit board or the like in a known manner. However, the present invention is not intended to be limited in this manner and a known mounting portion for surface mounting the connector is within the scope of the invention.

Figure 8:
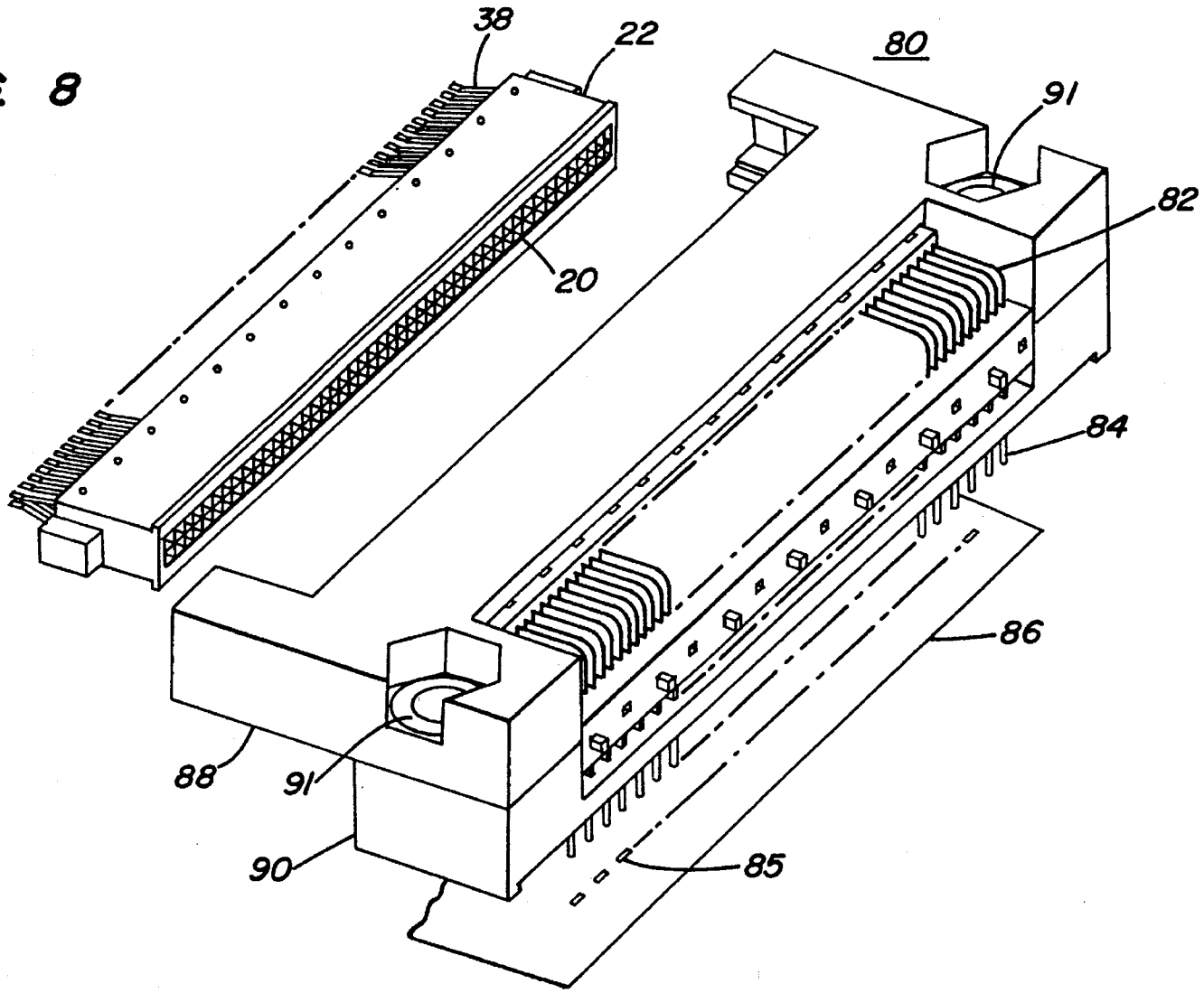
FIG. 8 shows a perspective view of a pin header and connector housing in accordance with the present invention.

A terminal pin header 80 for mating with connector housing 22 is shown in FIG. 8. Upon mating of the pin header 80 and the connector housing 22 in the manner set forth below, electrical connection is established between a plurality of terminal pins 82 disposed in the header 80 and the contact beams 38 disposed in connector housing 22. Header 80 is a right angle header wherein the terminal pins 82 are bent substantially at right angles within the header in the manner set forth in further detail below.

The circuit board end 84 of the terminal pins is inserted into holes 85 in a printed circuit board 86 and solderably connected thereto in a known manner for establishing electrical connection between the printed circuitry (not shown) on the circuit board and the contact beams 38. Accordingly, the mounting portion 68 of the contact beams 38 can be connected to a second printed circuit board or the like such that an electrical connection is established between the first and second printed circuit boards for carrying out a variety of functions in a known manner.

Figure 9B:
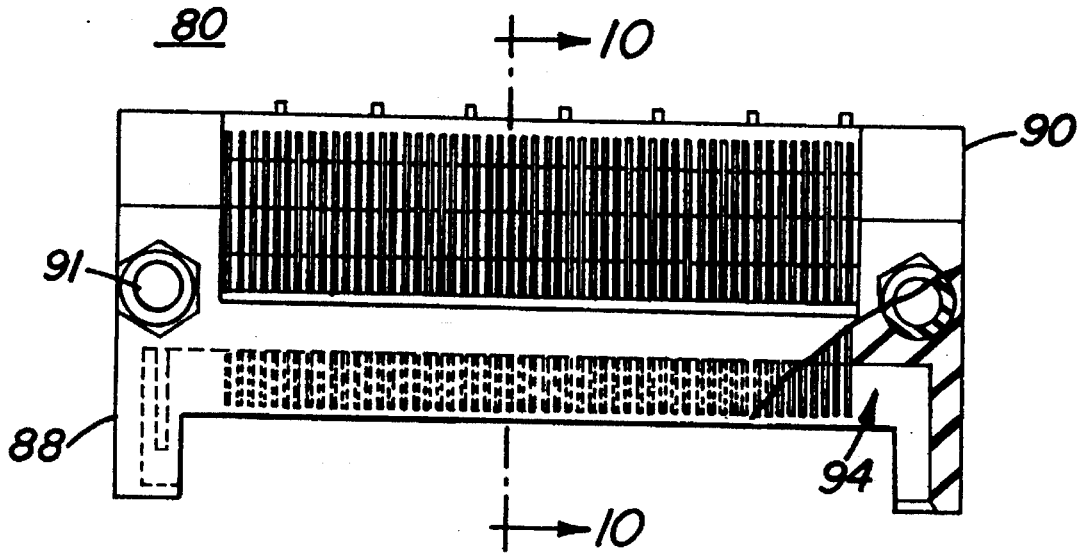
FIG. 9*b* shows a longitudinal side view of a pin header in accordance with the present invention.
Figure 9A:
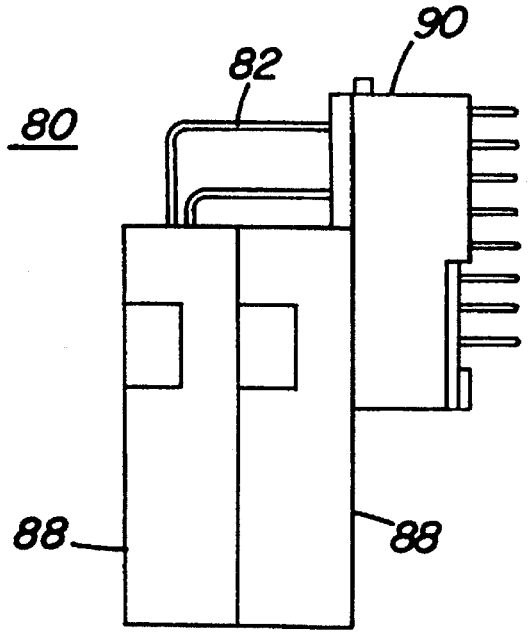
FIG. 9*a* shows a lateral side view of a pin header in accordance with the present invention.
Figure 10:
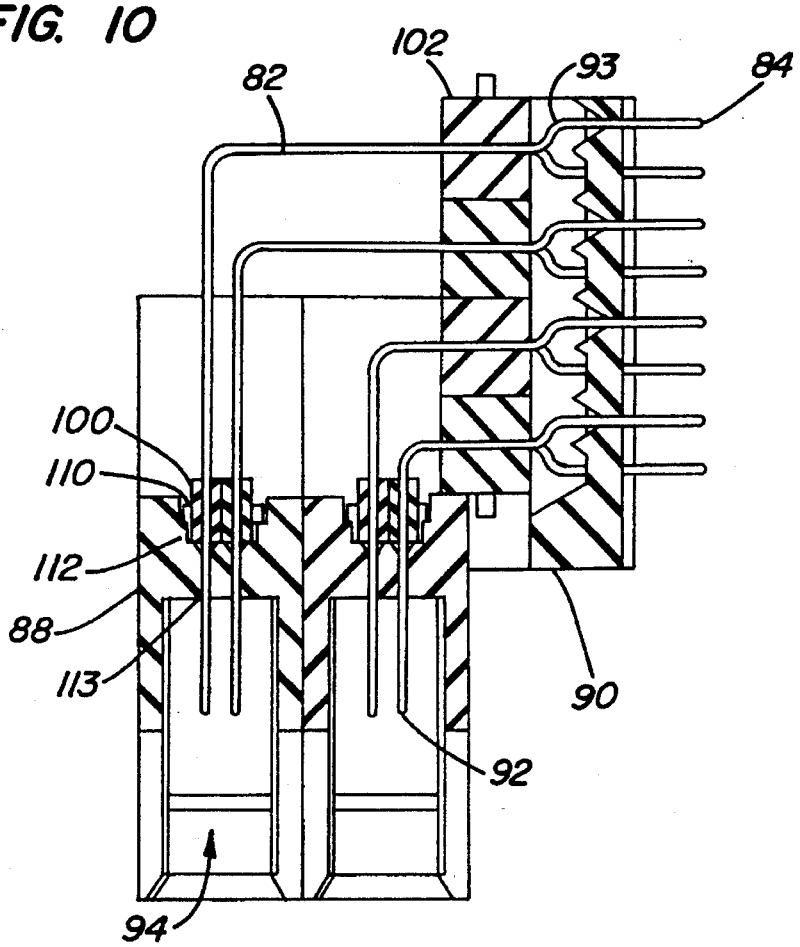
FIG. 10 shows a cross-sectional view taken along the lines 10—10 of the pin header shown in FIG. 9*b*.

The terminal pins 82 are disposed in header housing 88 and stand-off pin guide 90, wherein pin guide 90 is bolted to header housing 88 by bolts 91. As shown in FIGS. 9*a* and 10, in one embodiment of the present invention eight longitudinal rows of terminal pins 82 are disposed in the pin header 80. In this embodiment, two adjacent header housings 88 are mated together. However, the present invention is not intended to be limited in this manner, and any number of longitudinal rows of pins can be provided, depending upon the application requirements. Thus, as shown in FIG. 11, in another embodiment, four longitudinal rows of terminal pins are provided with only one header housing 88.

Figure 11:
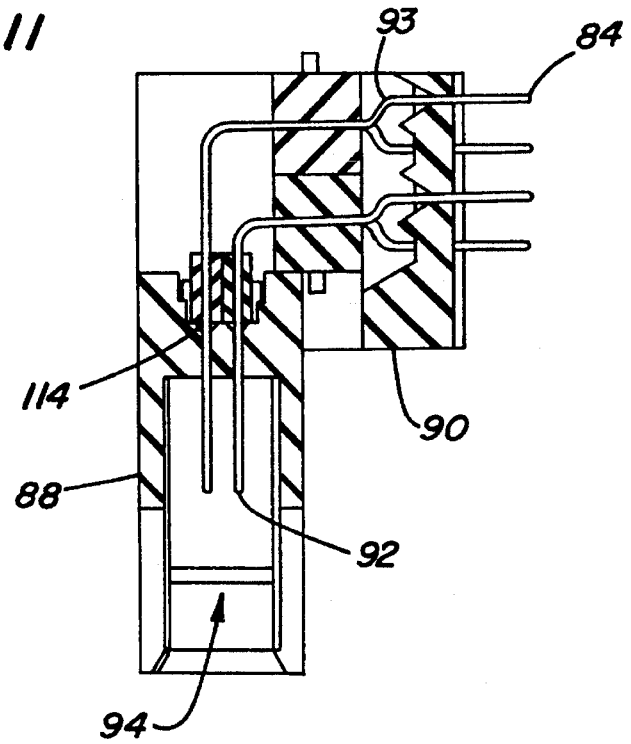
FIG. 11 shows a cross-sectional view of another embodiment of a pin header in accordance with the present invention.
Figure 12B:
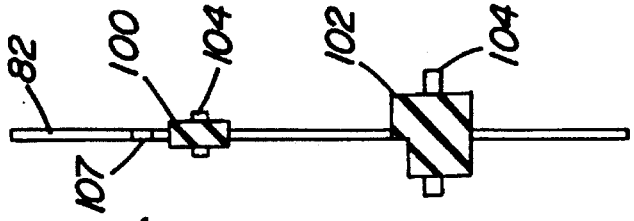
FIGS. 12*a*–12*e* show a row of terminal pins and alignment wafers in accordance with the present invention.
Figure 12A:
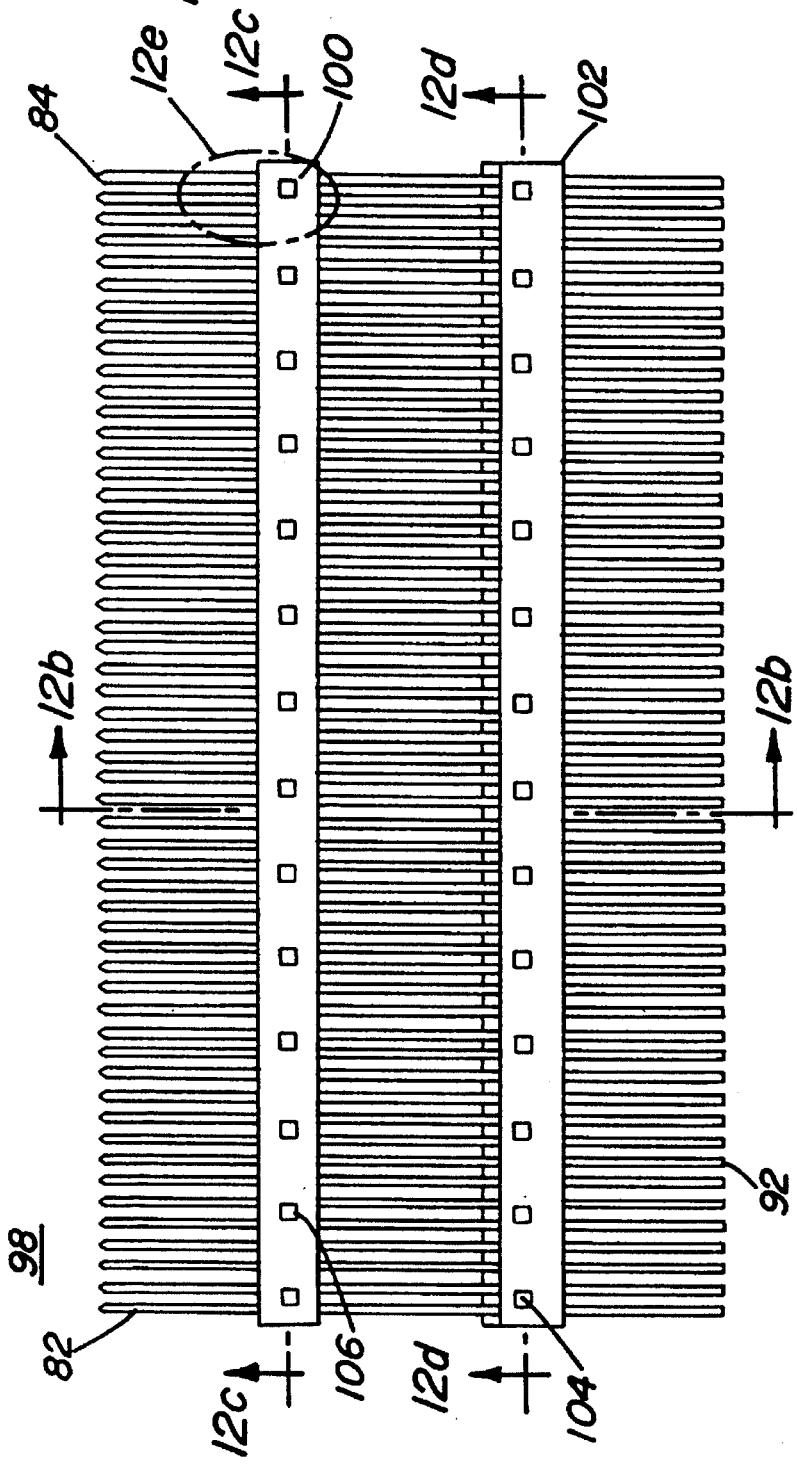
Figure 12C:
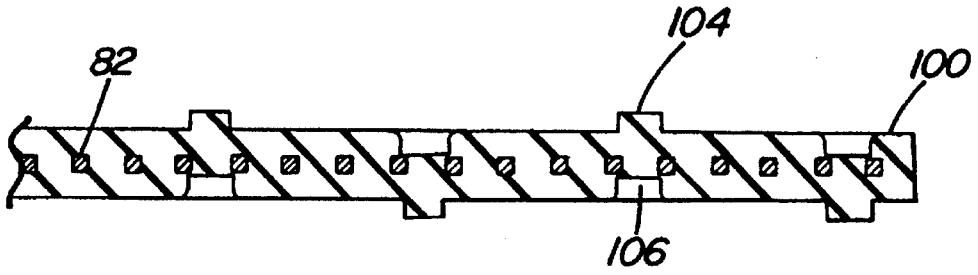
Figure 12D:
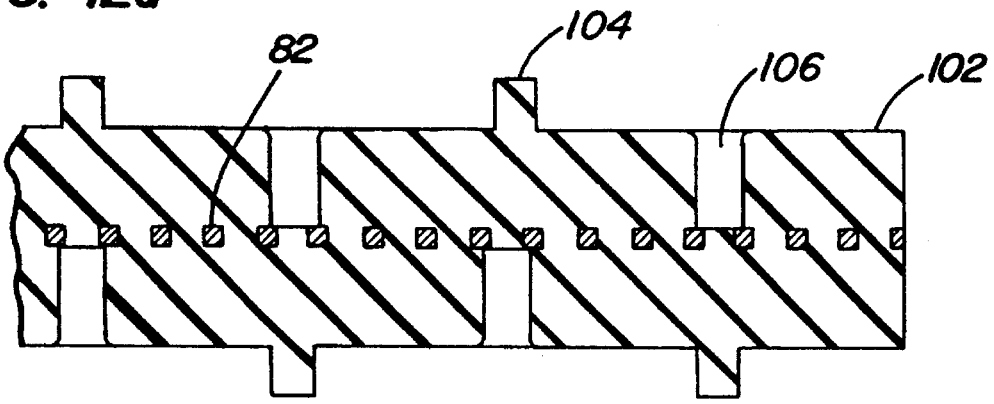
Figure 12E:
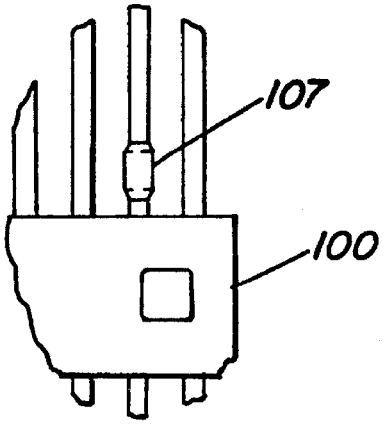
Figure 13A:
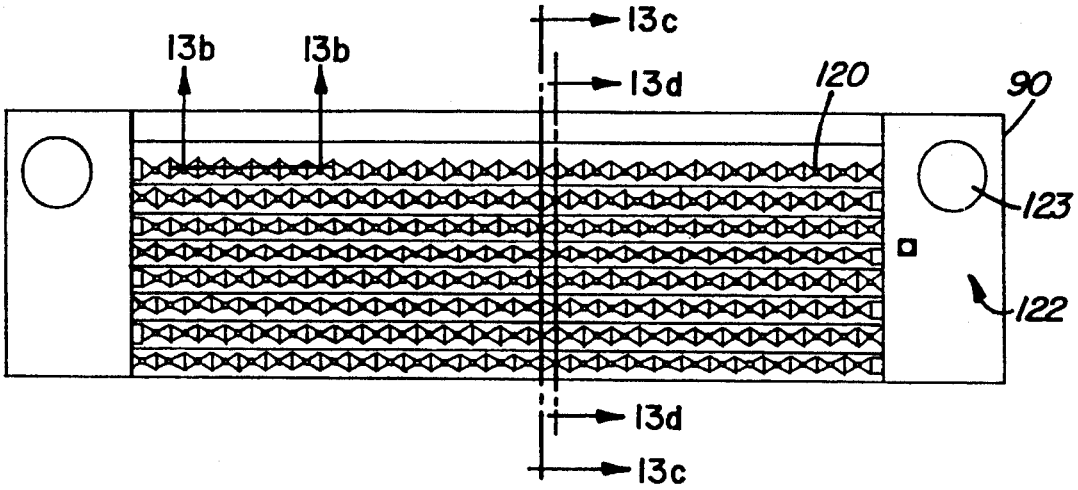
FIGS. 13*a*–13*d* show a stand-off pin guide in accordance with the present invention.
Figure 13B:
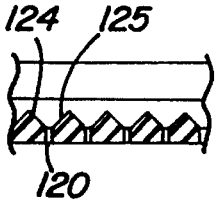
Figure 13C:
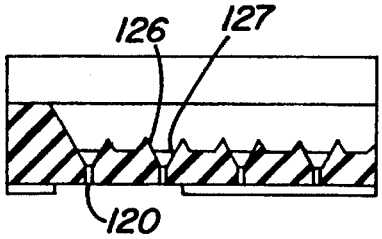
Figure 13D:
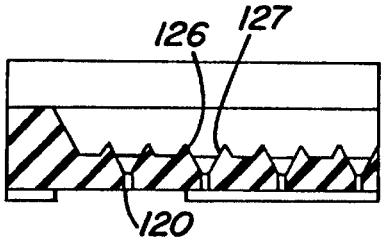

Referring to FIGS. 10 and 11, at the connector end 92 of the terminal pins the pins are aligned in two adjacent rows per each header housing 88. The number and arrangement of the terminal pin rows at the circuit board end 84 of the pins 82 can be configured to meet the desired mating requirements for the printed circuit board. Thus, in order to provide pins aligned in four longitudinal rows, using one header housing 88, or eight rows, using two header housings 88, at the circuit board end 84 of the terminal pins, the pins are bent substantially at a right angle 93 with the pins in one vertical column being bent in an upward direction and the pins in an adjacent vertical column being bent in a downward direction.

Referring to FIG. 8 and FIGS. 10 and 11, in order to mate the connector housing 22 and the header 80, the connector housing is inserted into the cavity 94 in the header housing 88. In an embodiment with two header housings 84, two separate connector housings 22 are mated with the header. When the connector housing 22 is inserted into cavity 94 the connector end 92 of the two adjacent rows of terminal pins is inserted into the corresponding adjacent rows of pin insertion openings 20 such that the pins contact the contact beams 38 in the manner described above. As set forth in detail below, because of the alignment features of the header 80 the pins are simply inserted into the connector housing 22 without interference such as pin stubbing.

Referring to FIGS. 12*a*–12*e*, a longitudinal row 98 of terminal pins 82 is molded into a top retention and alignment wafer 100 and a bottom retention and alignment wafer 102, the wafers 100 and 102 comprising a molded plastic material. During formation of a row of terminal pins, the terminal pins are aligned in a die and the molded wafers are formed out of molten plastic material with projections 104 and sockets 106 being formed as part of the wafers. During formation of the wafers, projections in the mold form the sockets 106. The projections on the mold extend into contact with and positively locate the row of pins, i.e. sockets 106 extend into contact with the pins, such that alignment of the pins can be measured and maintained within a desired tolerance. The pins can be embossed to form a bulge 107 such that the bulge is used to positively secure the row of pins in the header housing when the pins are inserted therein in the manner set forth below.

In order to form adjacent longitudinal rows of terminal pins 82, individual rows 98 of pins and wafers are bent substantially at right angles, as shown in FIGS. 10 and 11, and the wafers 100, 102 of one such bent row of pins are joined to the wafers of another bent row of pins by inserting the projections 104 of the wafers of one row into the sockets 106 of the wafers of the other row. One of ordinary skill in the art will recognize that the top and bottom wafers are sized appropriately to provide a desired spacing between the pins in a vertical column of pins, taking into account the additional right angle bend 93 in the pins.

Referring once again to FIGS. 10 and 11, after the individual longitudinal rows of pins are bent substantially at a right angle and adjacent rows of pins are joined by connecting wafers 100, 102, the top wafers 100 are inserted into wafer cavity 110 in each of the header housings 88. Projections 104 of the wafer 100 are supported upon shoulder 112 of the housing and the connector end 92 of the pins extends through adjacent pin holes 113 in the header housing 88. Countersinks 114 in the pin holes 113 assist in the positive location of the pins in the pin holes and obviate pin stubbing. Accordingly, adjacent rows of pins are properly aligned within the header housing such that the desired tolerances of the connector components are maintained and the header can be simply mated with the connector housing such that the pins are effectively connected to the contact beams in the connector housing in the manner set forth above.

Referring to FIGS. 13*a*–13*d*, in order to provide for proper alignment, within a desired tolerance, of the circuit board end 84 of the pins when the pins are connected to the printed circuit board 86, stand-off pin guide 90 includes a plurality of longitudinal rows of pin guide holes 120. In the embodiment shown in FIG. 13*a*, eight longitudinal rows of pin guide holes are provided for receiving eight rows of terminal pins discussed above. It should be noted that the rear surface 122 of the pin guide is mounted to the header housing 88 with the bolts 91 extending through bolt holes 123.

In order to provide for positive location of the pins 82 in the pin guide holes 120, ridges in the pin guide form four inclined ramp surfaces 124, 125, 126, 127 around each of the holes 120 wherein the ramp surfaces extend into communication with the holes 120. Accordingly, the pins are positively inserted into the pin guide 90 along the ramp surfaces and into the holes 120. Thus, pin stubbing is obviated and the ridges ensure that the pins are properly guided into the pin guide holes.

Thus, the present invention provides for connection of a large array of pins to a printed circuit board such that all of the pins are properly aligned and thus, can be simply inserted into their respective holes on the board.

It is to be understood that, even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An electrical connector, comprising:

a pin housing; and two or more rows of terminal pin inserts disposed in said pin housing, each said row of terminal pin inserts comprising:

a plurality of terminal pins having first and second ends, said terminal pins disposed in first and second connecting wafers, said first connecting wafer located proximate said first end and said second connecting wafer located proximate said second end, wherein a first row of said terminal pin inserts is connected to a second row of said terminal pin inserts by connecting said first connecting wafer of said first row of terminal pin inserts to said first connecting wafer of said second row of terminal pin inserts and further connecting said second connecting wafer of said first row of terminal pin inserts to said second connecting wafer of said second row of terminal pin inserts.

2. The electrical connector of claim 1, said pin housing having a first and second cavity, wherein said first connecting wafer of each said first and second rows of terminal pin inserts is disposed in said first cavity and said first end of said terminal pins of each said first and second rows of terminal pins inserts extends into said second cavity.

3. The electrical connector of claim 1, each said first and second connecting wafers having a side surface, a plurality of projections extending from said side surface and a plurality of sockets extending into said side surface, wherein said first row of terminal pin inserts is connected to said second row of terminal pin inserts by inserting said projections of said first connecting wafer of said first row of terminal pin inserts into said sockets of said first connecting wafer of said second row of terminal pin inserts and further inserting said projections of said second connecting wafer of said first row of terminal pin inserts into said sockets of said second connecting wafer of said second row of terminal pin inserts.

4. The electrical connector of claim 3, each said terminal pin having a pin surface, wherein said sockets extend from said side surface into contact with said pin surface.

5. The electrical connector of claim 1, further comprising a pin guide having two or more rows of pin holes extending through said pin guide for receiving said second end of said terminal pins, said pin guide further having ridges forming four inclined ramp surfaces around each said pin hole and extending into communication with each said pin hole.

6. The electrical connector of claim 1, wherein said terminal pins are bent substantially at a right angle between said first and second connecting wafers.

7. The electrical connector of claim 1, wherein said second end of said terminal pins is bent substantially at a right angle in a first direction and is further bent substantially at a right angle in a second direction, said first direction being substantially normal to said second direction.

8. An electrical connector assembly, comprising:

a first connector comprising:

a pin housing having a first and second cavity;

two or more rows of terminal pin inserts, each said row of terminal pin inserts comprising:

a plurality of terminal pins having first and second ends, said terminal pins disposed in first and second connecting wafers, said first connecting wafer located proximate said first end and said second connecting wafer located proximate said second end, wherein a first row of said terminal pin inserts is connected to a second row of said terminal pin inserts by connecting said first connecting wafer of said first row of terminal pin inserts to said first connecting wafer of said second row of terminal pin inserts and further connecting said second connecting wafer of said first row of terminal pin inserts to said second connecting wafer of said second row of terminal pin inserts;

said first connecting wafer of each said first and second rows of terminal pin inserts disposed in said first cavity and said first end of said terminal pins of each said first and second rows of terminal pins inserts extending into said second cavity;

a second connector comprising:

a contact housing having two or more rows of insertion bores corresponding in number to the number of rows of terminal pin inserts; and a plurality of contact beams disposed in said housing such that one of said contact beams is disposed in a corresponding one of said insertion bores;

whereby said contact housing is disposed in said second cavity of said pin housing such that said first end of each one of said terminal pins is inserted into a corresponding one of said insertion bores and contacts said contact beam disposed therein.

9. The electrical connector assembly of claim 8, said contact beams having a first and second end, wherein said first end is supported in said contact housing and said terminal pins contact said second end.

* * * * *